United States Patent [19]

Mochizuki

[11] Patent Number: 4,691,871

[45] Date of Patent: Sep. 8, 1987

[54] CUTTING APPARATUS

[75] Inventor: Nobumasa Mochizuki, Kawagoe, Japan

[73] Assignee: Mochizuki Precision Machine Industries Co., Ltd., Kawagoe, Japan

[21] Appl. No.: 771,130

[22] Filed: Aug. 30, 1985

[30] Foreign Application Priority Data

| | | | |
|---|---|---|---|
| Aug. 31, 1984 | [JP] | Japan | 59-133480[U] |
| Nov. 15, 1984 | [JP] | Japan | 59-173551[U] |
| Dec. 15, 1984 | [JP] | Japan | 59-264762 |
| Mar. 28, 1985 | [JP] | Japan | 60-45284[U] |

[51] Int. Cl.[4] ..... B02C 18/16

[52] U.S. Cl. ..... 241/166; 241/236; 241/243; 241/285 A

[58] Field of Search ..... 241/166, 167, 235, 236, 241/243, 285 A, 293, 294, 295

[56] References Cited

U.S. PATENT DOCUMENTS

| | | | |
|---|---|---|---|
| 3,662,964 | 5/1972 | Rossler | 241/236 X |
| 4,125,228 | 11/1978 | Brewer | 241/243 |
| 4,385,732 | 5/1983 | Williams | 241/236 |
| 4,489,897 | 12/1984 | Turner et al. | 241/236 X |

FOREIGN PATENT DOCUMENTS

| | | |
|---|---|---|
| 965465 | 6/1957 | Fed. Rep. of Germany . |
| 55-41309 | 9/1980 | Japan . |

*Primary Examiner*—Timothy V. Eley

*Attorney, Agent, or Firm*—Wenderoth, Lind & Ponack

[57] ABSTRACT

A cutting apparatus for cutting objects into minute pieces with high exactitude and high precision comprises, as an integral unit, a pair of cutter shafts disposed substantially in parallel to each other, a motor attached to one of the cutter shafts, gears for rotating the other cutter shaft in a direction opposite to the direction in which the one cutter shaft is rotated, a plurality of substantially disk-like cutters fitted around each of the cutter shafts, and a plurality of substantially disklike spacers fitted around each of the cutter shafts. The cutters and spacers around each of the cutter shafts are alternately arranged and brought into intimate contact with each other in the axial direction of each of the cutter shafts. The cutters and the spacers around the one cutter shaft are closely opposed respectively to the spacers and the cutters around the other cutter shaft so as to hold the cutters on the respective shafts in mesh with each other. The cutting apparatus further comprises a dish-shaped shoot which is disposed at a position immediately above the cutters and spacers for effectively guiding the objects onto the cutters and spacers to enhance the cutting efficiency, and a pair of scrapers which are disposed on the sides of the cutters opposite that on which the cutters and the spacers are opposed, and which are provided with corrugated engaging claws for engaging with the cutters and the spacers to effectively prevent the objects from falling from between the cutters and spacers.

6 Claims, 38 Drawing Figures

CUTTING APPARATUS

BACKGROUND OF THE INVENTION

1. Field of the Invention

The present invention relates to a cutting apparatus adapted to cut swarf, cuttings and chips discharged out of a machine tool etc. into minute pieces.

2. Description of the Prior Art

Generally, swarf, cuttings and chips (hereinafter referred to collectively as 'chips') being discharged out of a machine tool such as a lathe etc. in a machining factory are scattered about the machine tool and thereby deteriorate the working environment and safety thereof. For this reason, workers are required to periodically remove the scattered chips However, since almost all of such chips are elongated and have a shape like a helical spring, these become bulky and are difficult to handle. Even when the chips are thrown into a chip box or pit set within a workshop, for example, the chip box or pit is filled with the chips within a short period of time and the overflowing chips are scattered thereabouts to deteriorate the working environment again.

Under these circumstances, there has been an increased demand for cutting apparatuses easy to handle and suitable for cutting chips into minute pieces. To satisfy the demand, there have heretofore been proposed various cutting apparatuses of this type. For example, German Pat. No. 965,465 discloses a slitter comprising a pair of rotary shafts disposed in parallel with each other and a plurality of disklike cutter members disposed at prescribed intervals, snugly fitted around each of the rotary shafts, and each provided on the circumference of the cutter body thereof with a multiplicity of cutting edge projections so that the cutting edge projections of the cutter members around one of the rotary shafts are held in mesh with those of the cutter members around the other rotary shaft in a staggered fashion. Further, Japanese Utility Model Publication No. 55-41309 teaches a crusher wherein a plurality of disklike cutter members are disposed at prescribed intervals, snugly fitted around each of rotary shafts, each provided on the circumference of the cutter body thereof with a multiplicity of claws, in place of the cutting edge projections as in the aforementioned German patent, for catching objects being treated, so that the cutter members around one of the rotary shafts are arranged in mesh with and at the opposite side surfaces thereof in intimate contact with those around the other rotary shaft.

In the former prior art device, however, since the crushing function can only be attained when the cutting edge projections mesh with each other, the crushing is effected intermittently and therefore is undesirable. Further, in the latter prior art device, since the cutter bodies are provided on the circumferences thereof with the claws complicated in shape, it is difficult to produce the cutter members. Furthermore, in any of these prior art devices, since a large gap is left between the leading end of the cutting edge projection or claw and a collar, there is a fair possibility of the objects under treatment coming out of the gap when the corresponding cutting edge projections or claws engage with each other, and since a drive source for rotating the cutter members is disposed apart from the casing, the device becomes large-scale as a whole and necessitates a large installation area.

OBJECTS AND SUMMARY OF THE INVENTION

The present invention has been accomplished in view of the drawbacks suffered by the conventional cutting devices as described above.

One object of the present invention is to provide a cutting apparatus capable of preventing objects under cutting treatment from coming out of gaps between cutter members and of reducing its installation area.

Another object of the present invention is to provide a cutting apparatus capable of being easily attached to the takeout end of a chip conveyor for conveying chips discharged out of a machine tool.

Still another object of the present invention is to provide a cutting apparatus capable of cutting objects under treatment into minute pieces with high exactitude and high precision.

To attain the objects described above, according to the present invention, there is provided a cutting apparatus which comprises, as an integral unit, a pair of cutter shafts disposed substantially in parallel to each other, a motor attached to one of the cutter shafts for rotating the one cutter shaft, means for rotating the other cutter shaft in a direction opposite to the direction in which the one cutter shaft is rotated, a plurality of substantially disk-like cutters fitted around each of the cutter shafts, a plurality of substantially disklike spacers fitted around each of the cutter shafts, the cutters and the spacers around each of the cutter shafts being alternately arranged and brought into intimate contact with each other in the axial direction of each of the cutter shafts, the cutters and the spacers around one of the cutter shafts being closely opposed respectively to the spacers and the cutters around the other cutter shaft so as to hold the cutters in mesh with the opposed spacers.

The aforementioned and other objects, characteristic features and advantages of the present invention will become apparent to those skilled in the art as the disclosure is made in the following description of preferred embodiments of the invention, as illustrated in the accompanying drawings.

DETAILED DESCRIPTION OF THE PREFERRED EMBODIMENTS

Figure 1:
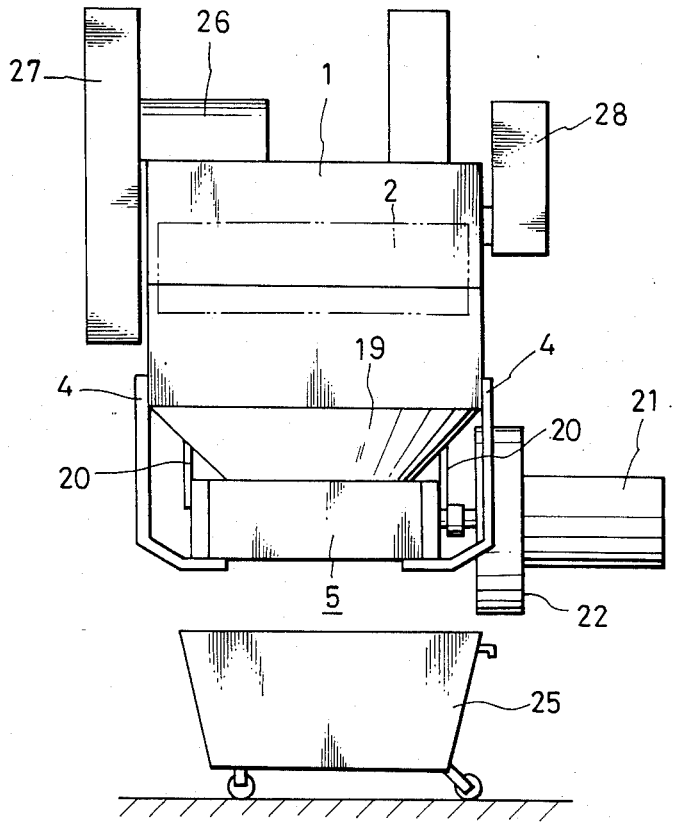
FIG. 1 is a schematic front view illustrating one embodiment of a cutting apparatus according to the present invention.

The present invention will now be described with reference to the illustrated embodiments.

FIGS. 1 through 6 illustrate one embodiment of a chip cutting apparatus according to the present invention, in which reference numeral 1 denotes a conveyor casing disposed in the vicinity of a machine tool (not shown) and within the conveyor casing 1 there is accommodated a takeout end of a chip conveyor 2 for conveying chips discharged out of the machine tool, which takeout end defines a lower takeout opening 3. Denoted by numeral 4 is a pair of support arms of a substantially L-shaped cross section having their respective one ends fixed to side plates 1*a* of the conveyor casing 1 and their respective other ends adapted to support a cutting implement 5 thereon.

Figure 2:
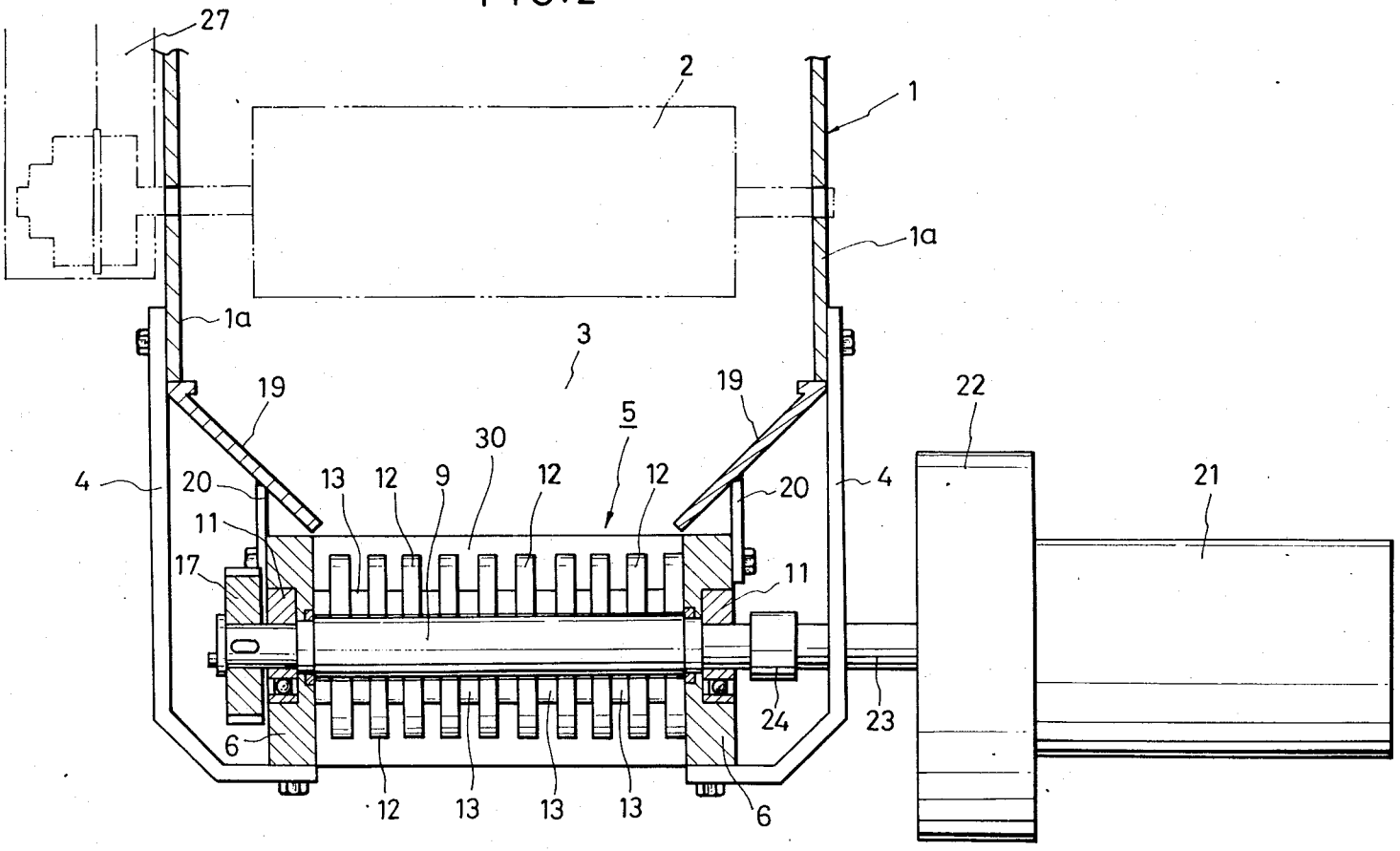
FIG. 2 is an enlarged cross-sectional view illustrating the principal part of the embodiment.
Figure 3:
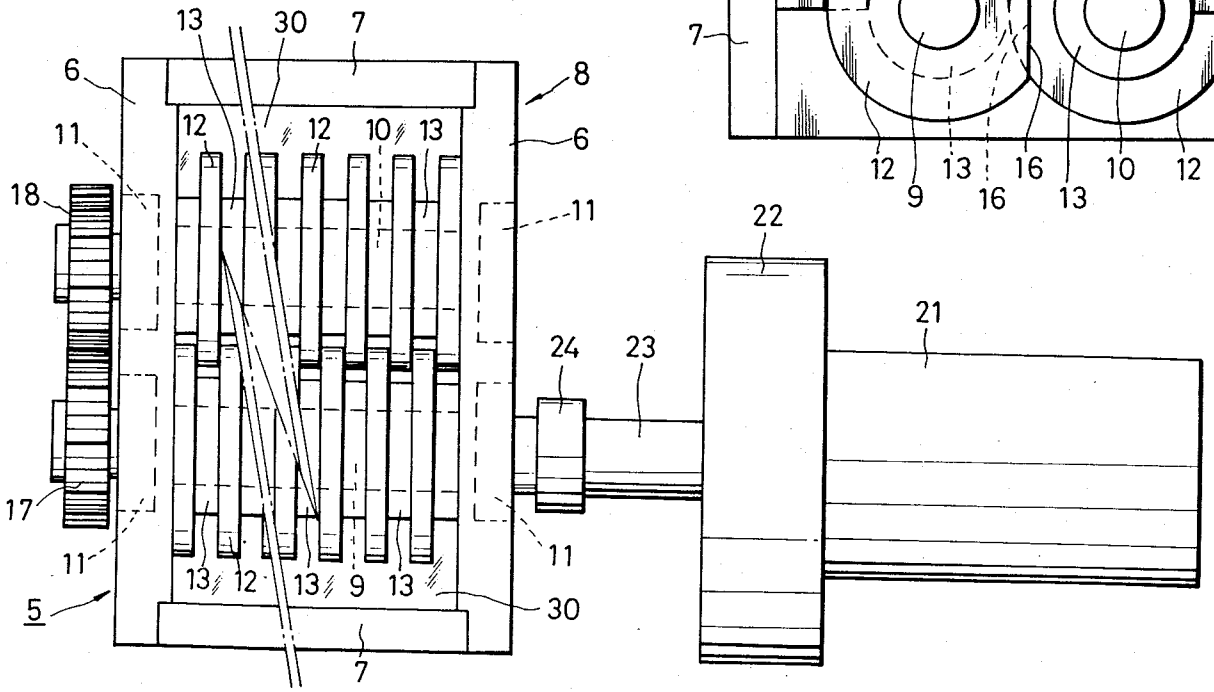
FIG. 3 is a plan view illustrating the principal part of the embodiment.

The cutting implement 5 comprises as illustrated in FIG. 2 or FIG. 3, a rectangular frame 8 composed of a pair of opposed longitudinal frame members 6 and a pair of opposed lateral frame members 7, a pair of cutter shafts 9 and 10 each having a spline and rotatably supported within the rectangular frame 8 by means of bearings 11, and a plurality of alternately arranged cutters 12 and spacers 13 spline fitted and fixed around the cutter shafts 9 and 10 so that the cutters and spacers around one of the cutter shafts are closely opposed respectively to the spacers and cutters around the other cutter shaft.

Figure 5:
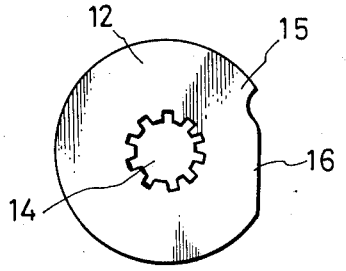
FIG. 5 is a front view illustrating a cutter constituting a part of the cutting implement.

Each of the cutters 12 is formed of a disk to have a central spline hole 14 for snugly admitting the cutter shaft 9 or 10 and is provided on the circumference thereof with a pawl-shaped projection 15 formed by cutting and a relief portion 16 continuing to the projection 15 and extending substantially straightforward, as illustrated in FIG. 5.

Each of the spacers 13 is formed of a disk having a smaller diameter than that of the cutter 12 and having a central spline hole (not shown) similar to the spline hole 14 in the cutter 12.

To the corresponding ends of the cutter shafts 9 and 10 there are fixed gears 17 and 18 which engage with each other as shown in FIG. 3 so as to be rotatable in the opposite directions at the same speed. Reference numeral 19 denotes a dish-shaped shoot disposed at a position immediately below the takeout opening 3 of the chip conveyor 2 and mounted on support members 20 which are fixed one each to the pair of opposed longitudinal frame members 6 as is best shown in FIG. 2. Denoted by 21 in FIG. 1 or FIG. 2 is a motor equipped with a decelerator 22 and having a drive shaft 23 connected to one of the cutter shafts through a coupling 24. In FIG. 1, numeral 25 denotes a chip box positioned below the cutting implement 5, Numeral 26 denotes a motor disposed on the side of the takeout end of the conveyor 2*a*, Numeral 27 denotes a chain casing, and Numeral 28 denotes a switch box. Numeral 29 in FIG. 6 denotes a chip being treated. Further, in FIG. 4, each of scrapers 30 having an upper tapered surface 30*a* inclined downwardly and also having a lower corrugated engaging pawl 31 whose configuration conforms to a combined configuration of the alternately arranged cutters 12 and spacers 13 and which is brought into intimate contact sideways with the cutters 12 and spacers 13.

Figure 7:
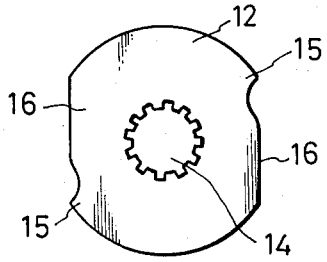
FIGS. 7(*a*) to 7(*d*) are front views illustrating modifications of the cutter usable in the present invention.
Figure 7:
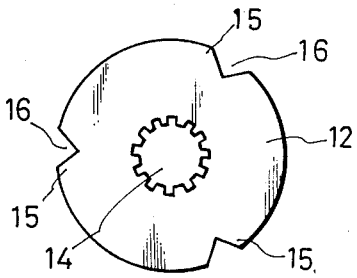
Figure 7:
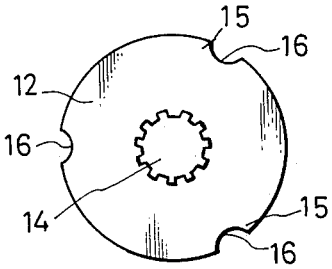
Figure 7:
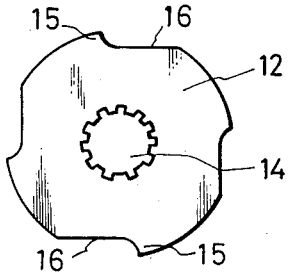

The cutter 12 may be modified as shown in FIGS. 7(*a*) to 7(*d*). The portions of each of the cutter modifications identical with or similar to those of the cutter shown in FIG. 5 are indicated by the same reference numerals as used in FIG. 5. In the modification of the cutter shown in FIG. 7(*a*), a pair of combinations each comprising a projection 15 and a relief portion 16 are symmetrically disposed relative to a central spline hole 14. In other modifications shown in FIGS. 7(*b*) and 7(*c*), a plurality of V- or U-shaped notches are formed, thereby allowing the corner portions to serve as projections 15 and the concave portions to function as relief portions 16. In a further modification shown in FIG. 7(*d*), a cutter 12 is provided on the circumference thereof with four projections 15 and four relief portions 16 continuing to the corresponding projections 15 and extending substantially straightforward. Any of these modifications of the cutter 12 has a plurality of projections 15 and relief portions 16, thereby shortening the chip cutting cycle and enhancing the cutting efficiency. When these cutters 12 are attached to the cutter shafts 9 and 10, the projections 15 and the relief portions 16 of the cutters 12 around one of the cutter shafts 9 and 10 are arranged so as to be capable of slightly colliding radially inwardly with the cutters 12 around the other cutter shaft.

Figure 4:
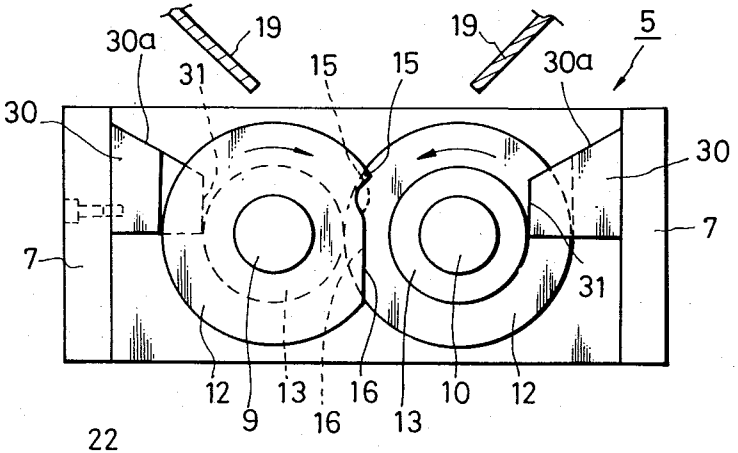
FIG. 4 is a front view illustrating a cutting implement used in the embodiment.
Figure 8:
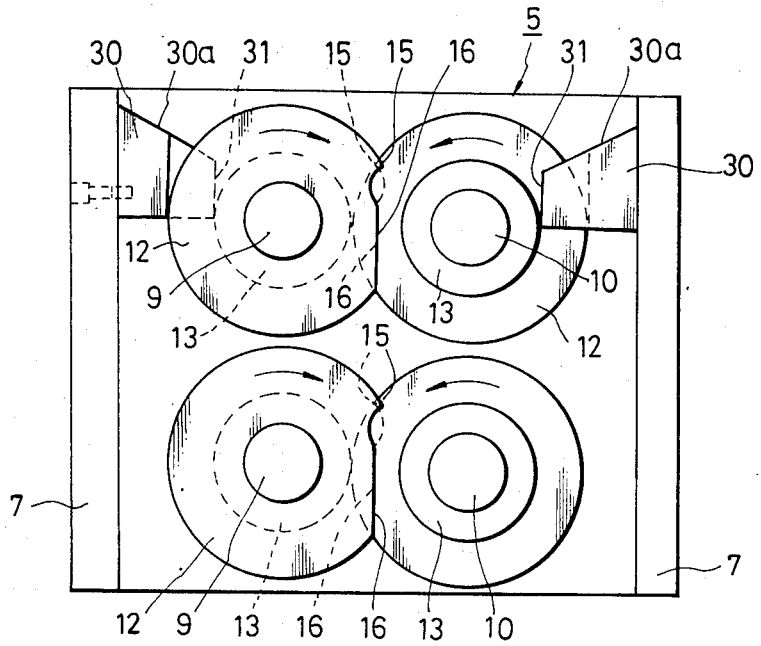
FIG. 8 is a front view illustrating another cutting implement usable in the present invention.
Figure 9:
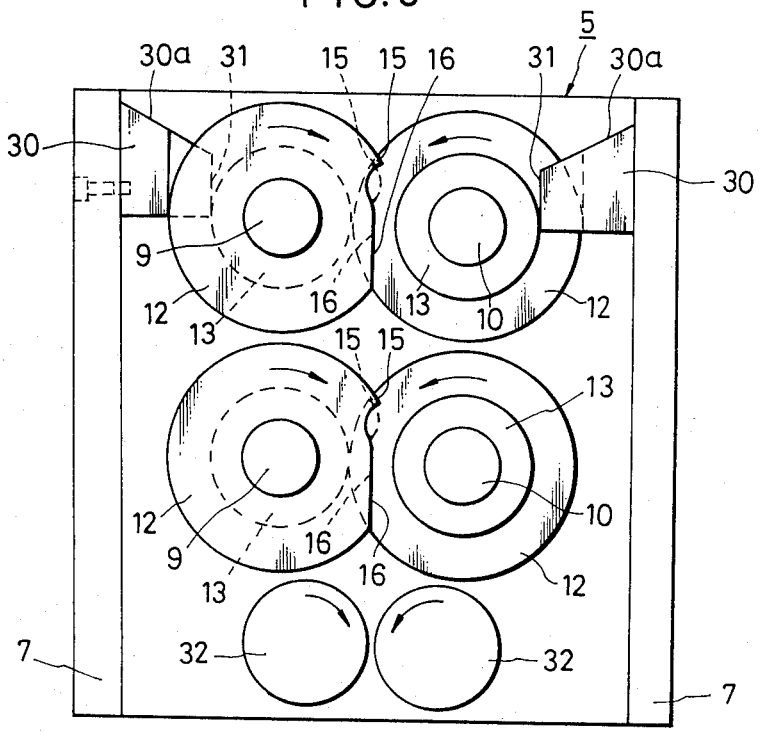
FIG. 9 is a front view illustrating still another cutting implement usable in the present invention.

FIGS. 8 and 9 illustrate other cutting implements 5 usable in the present invention. The portions of each of these cutting implements identical with or similar to those of the cutting implement 5 of FIG. 4 are indicated by the same reference numerals as used in FIG. 4. In FIG. 8, the cutting implement 5 comprises two pairs of cutter shafts 9 and 10 disposed in two stages and cutters 12 and spacers 13 disposed in two same manner as described hereinbefore, whereby the chip cutting process is carried out in two stages to facilitate cutting of the chips into minute pieces with high exactitude. The cutting implement 5 of FIG. 9 is characterized in that a pair of rotatable rollers 32 are added to the cutting implement 5 of FIG. 8 at a position below the lower pair of cutter shafts 9 and 10 for crushing the minutely cut chips to thereby further promote the minuteness of the piece of the chips.

Figure 10:
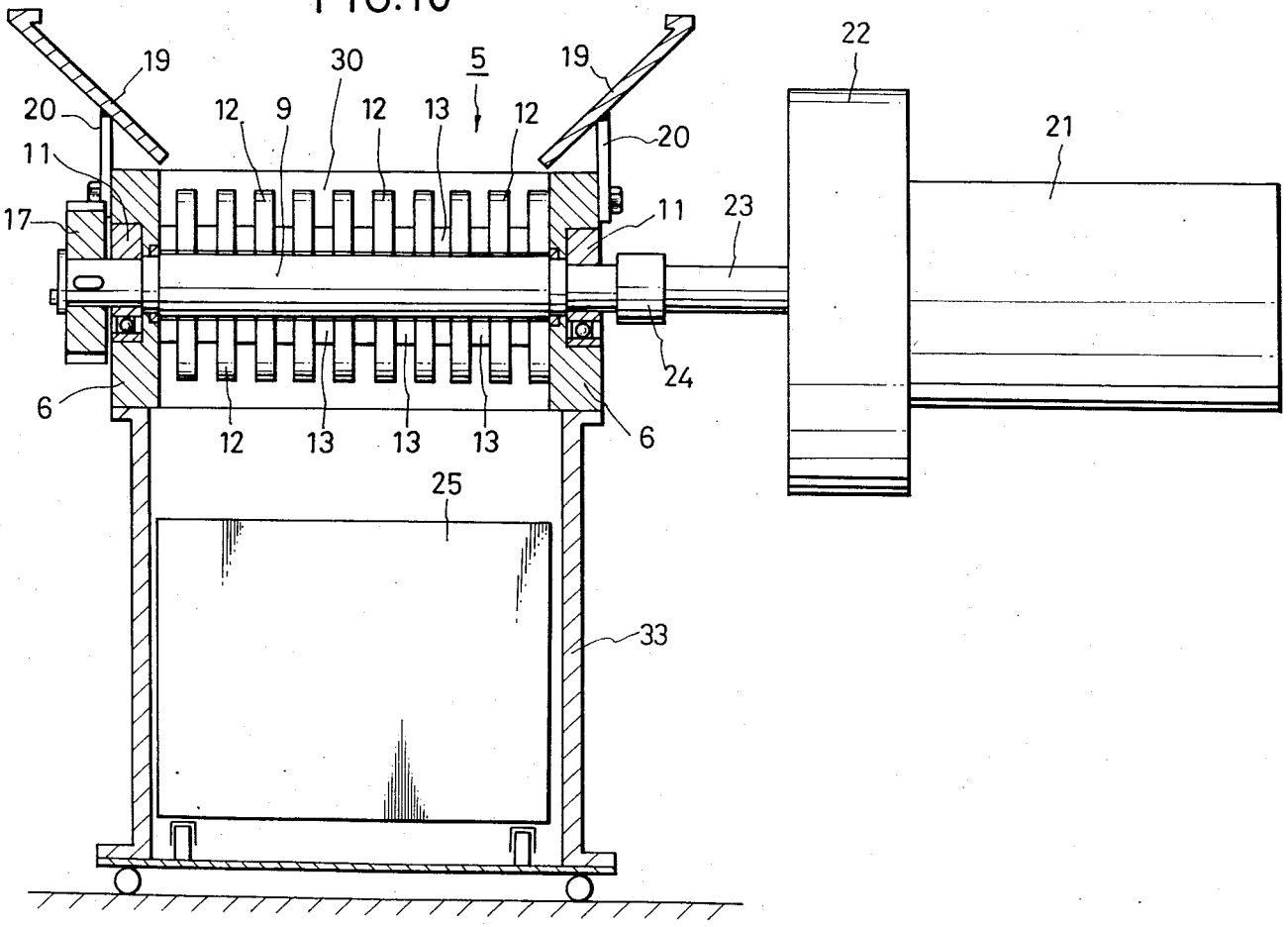
FIG. 10 is a partially sectioned front view illustrating a modification of the embodiment of FIG. 1.

FIG. 10 shows a modification of the cutting apparatus, in which the cutting implement 5 shown in FIGS. 1 through 4, FIG. 8 or FIG. 9 is mounted on a movable rack 33 within which the chip box 25 is accommodated, and the cutting implement 5 and a drive mechanism including the motor 21 are joined together into a unit. This movable type cutting apparatus can easily be installed without requiring work for attachment to a machine tool.

Installation of the stationary cutting apparatus shown in FIGS. 1 to 4 is accomplished by locating the upper edge of the shoot 19 at the edge of the takeout opening 3 of the conveyor casing 1, fixing the respective one ends of the support arms 4 to the side surface of the conveyor casing 1 and fixing the respective other ends of the support arms 4 to the frame 8 having the cutting implement 5, such as at the bottom surface thereof, for example. Installation of the movable type cutting apparatus shown in FIG. 10 is achieved by moving the rack 33 to locate the shoot 19 at a position of the discharge edge of a machine tool to which chips are conveyed.

Each of the cutting apparatuses having the constructions as described above is used by driving the motor 21 to transmit its power to one cutter shaft 9 associated with the drive shaft 23, thereby rotating the cutter shaft 9 and driving one gear 17 firmly attached to the end of the drive shaft 23, and driving the other gear 18 in engagement with the gear 17 by the drive force of the gear 17 to rotate the other cutter shaft 10 firmly attached to the other gear 18 in a direction opposite to the direction in which the cutter shaft 9 is rotated at the same speed as that of the cutter shaft 9. With the rotation of these cutter shafts 9 and 10, a plurality of cutters 12 and spacers 13 snugly fitted around one of the cutter shafts 9 and 10 and those around the other cutter shaft are rotated in the opposite directions as shown in FIG. 4, 6, 8 or 9 and are on standby for the purpose of cutting chips 29 into minute pieces.

When a machine tool is driven to start a cutting operation, the chips 29 discharged out of the machine tool are conveyed by the conveyor 2 to fall from the takeout opening 3 formed on the takeout side of the conveyor 2 onto the cutting implement 5. At this time, almost all of the chips 29 fall on the upper circumferential surfaces of the cutters 12 and the spacers 13. However, since the cutters and the spacers around each of the cutter shafts 9 and 10 are brought into intimate contact with each other in the axial direction of each of the cutter shafts and since the cutters around the cutter shafts are also brought into intimate contact with the opposed spacers around the cutter shafts in a substantially circumscribed state as shown in FIG. 4, there is no fear of the chips 29 passing through any of the fine gaps among the cutters and the spacers. Further, even when part of the chips 29 overflows on the side apart form the side on which the cutters 12 and the spacers 13 are opposed to each other, since the engaging pawls 31 of the scrapers 30 stop up the gaps between the cutters 12 and the spacers 13, it is possible to prevent the chips 29 from falling.

When the chips 29 fall on the circumferential surfaces of the cutters 12 and the spacers 13 of the cutting implement which are driven as described above, they are urged to the inside circumferential surfaces of the cutters 12 and the spacers 13 by the frictional force generated therebetween. However, since the inside circumferential surfaces of the cutters 12 and the spacers 13 are ordinarily in a substantially circumscribed state, the chips 29 continue their rolling on the circumferential surfaces of the cutters and the spacers without being drawn in the lower inside of the cutting implement 5. In this state, therefore, the chips 29 are not cut off.

Figure 6:
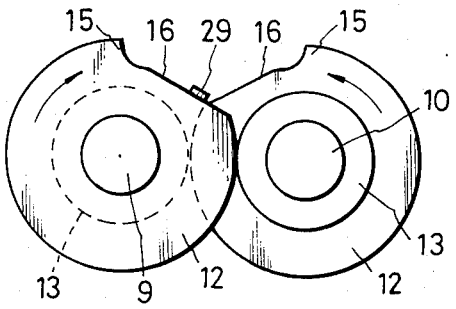
FIGS. 6(*a*) to 6(*d*) are explanatory views illustrating the cutting steps taken by the cutters in the order mentioned.
Figure 6:
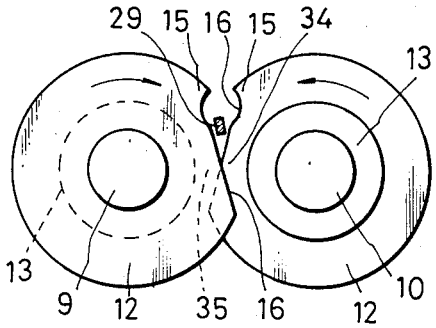
Figure 6:
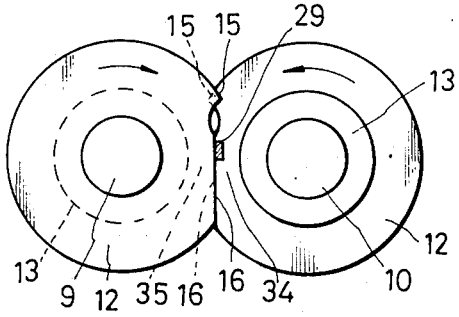
Figure 6:
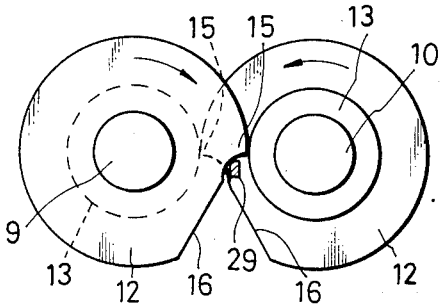

When the cutters 12 are further rotated to allow their relief portions 16 to be adjacent to each other as shown in FIG. 6(*a*), the chips 29 are caught and scooped by the projections 15 to be moved from the inside circumferential surfaces of the cutters 12 onto the relief portions 16. As the cutters 12 are rotated, the relief portions 16 are allowed to gradually rise and consequently, as shown in FIG. 6(*b*), there are formed gaps 34 and 35 between the relief portion 16 and the opposed circumferential surface of the spacer 13 and between those in the adjacent row. As a result, the chips 29 are moved into these gaps 34 and 35.

With the rotation of the cutters 12, the relief portions 16 are moved in the opposite directions toward the normal-line direction and the adjacent gaps 34 and 35 are directed as separated from each other. As a result, the chips 29 are curved along the peripheral edges of the relief portions 16 and become tense gradually. When the relief portions 16 are kept upright, as shown in FIG. 6(c), the adjacent gaps 34 and 35 are disposed back to back, and the chips 29 are corrugated along the peripheral surfaces of the cutters 12 and the spacers 13 to heighten their tension and are pushed against the fixed positions of the relief portions 16.

When the cutters 12 are rotated further from the aforementioned state, the projections 15 engage with the chips 29 as shown in FIG. 6(*d*), with the result that the chips 29 are further strained and pushed downwardly by the projections 15 and then cut off. Thus, a plurality of cut pieces having a length substantially the same as the thickness of the edges of the cutters 12 fall into the lower inside of the cutting implement 5.

The chips 29 thus cut into minute pieces fall into the chip box 25 and are accommodated therewithin. Since the chips 29 within the chip box 25 are minutely cut into pieces, they do not create large bulk and are easy to handle. By the use of the cutting implement shown in FIG. 8 or 9, the chips 29 are more minutely cut into pieces or crushed. Therefore, the cutting treatment is effected with high exactitude and promoted, and discharge of uncut chips 29 can be prevented effectively.

According to the present invention, as described above, since the chips discharged out of a machine tool etc. can be cut into minute pieces, bulkiness of the chips can be eliminated and the chips are easy to handle and can be conveyed more easily as compared with the conventional conveyance of the chips produced and left intact. Further, the chips can be prevented from scattering in the conveyance thereof. Therefore, a well-regulated working environment can be secured.

Furthermore, in the first embodiment of the cutting apparatus according to the present invention, since the cutting implement, shoot and motor are combined into an integral unit to reduce its installation area, the cutting apparatus may be practically used either in a stationary form by the attachment thereof to a prescribed position of a machine tool or in a movable form by the installation thereof on a rack. The movable type cutting apparatus can easily be installed relative to a preset or newly set machine tool. In addition, the installation space of the cutting apparatus of the present invention can be reduced.

FIGS. 11 through 30 show the second to fifth embodiments of the cutting apparatus according to the present invention. The portions identical with or similar to those of the first embodiment are indicated by the same reference numerals as used in FIGS. 1 through 5, and the description thereof is omitted in the following.

Figure 11:
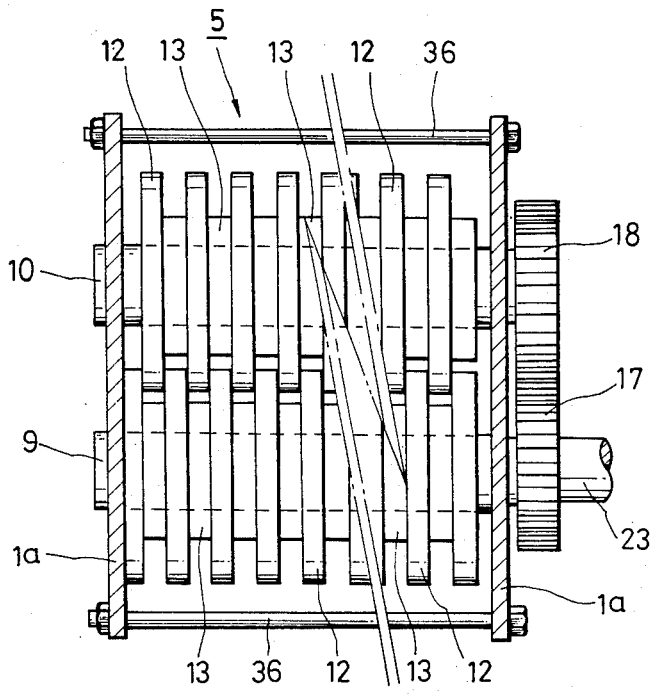
FIG. 11 is a plan view illustrating the principal part of a second embodiment of the cutting apparatus according to the present invnetion.

The cutting apparatus of the second embodiment of the present invention shown in FIG. 11 is adapted to be combined integrally with the takeout end of the chip conveyor 2. To be specific, the opposite side plates 1*a* of the conveyor casing 1 placed at the takeout end of the chip conveyor 2 are allowed to serve as the longitudinal frame members 6 of the cutting implement 5 in the first embodiment and connected to each other with connection levers 36, whereby the cutting implement 5 in the second embodiment is integrally attached to the conveyor casing 1 so as to be placed at a position immediately below the takeout end of the chip conveyor 2.

Figure 12:
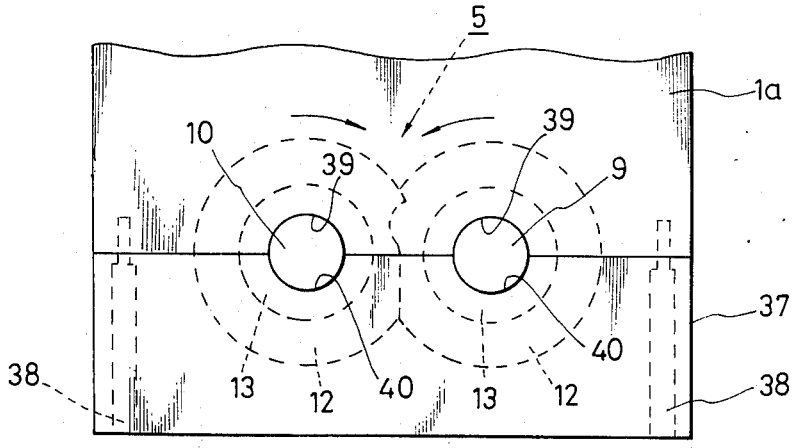
FIG. 12 is a front view illustrating a modification of the second embodiment.
Figure 13:
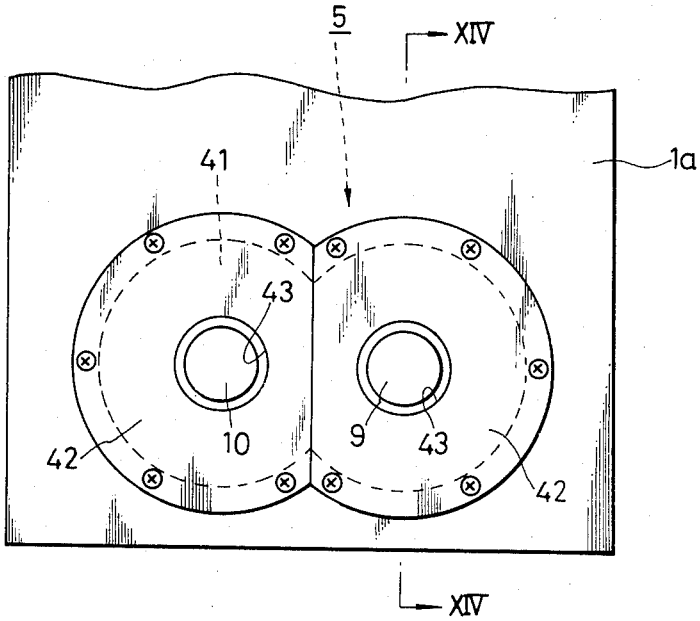
FIG. 13 is a front view illustrating another modification of the second embodiment.
Figure 14:
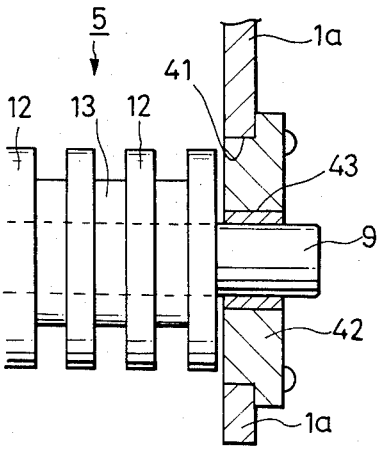
FIG. 14 is a cross-sectional view taken along line XIV—XIV in FIG. 13.

An attaching mechanism for the cutting implement 5 can be constructed as illustrated in FIG. 12, for example. To each of the side plates 1*a* having semi-circular bearing notches 39 is detachably connected a respective lower side plate 37 having semi-circular bearing notches 40 by means of fastening screws 38 so that the semi-circular bearing notches cooperate to form circles for admitting the cutter shafts 9 and 10, thereby making it easy to attach the cutting implement 5 to the preset conveyor 2. In the case shown in FIGS. 13 and 14, each of the side plates 1*a* has a substantially elliptical through hole 41 formed in the lower portion thereof and the through hole 41 is stopped up by a pair of side cover plates 42 which have holes 43 for admitting the cutter shafts 9 and 10. In this case, the cutting implement 5 can be taken out together with the side cover plates 42 by detaching the side cover plates 42 and, therefore, it can be maintained or repaired, if necessary, with high convenience.

Figure 15:
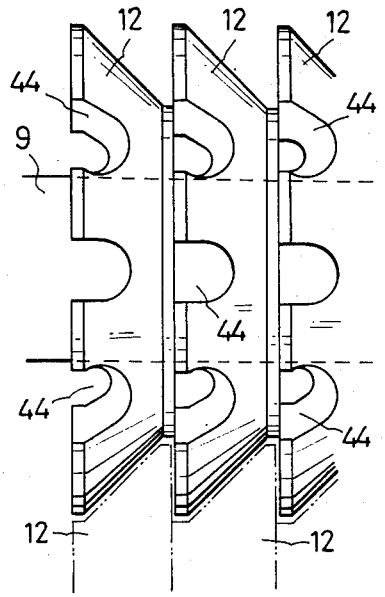
FIG. 15 is a plan view illustrating another cutter usable in the present invention.
Figure 16:
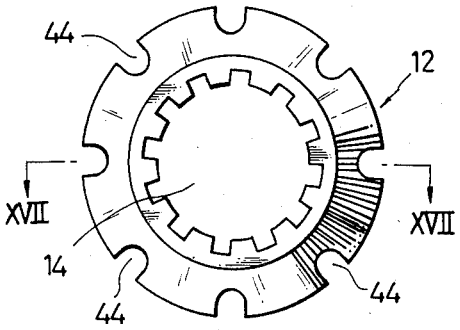
FIG. 16 is a front view illustrating the cutter of FIG. 15.
Figure 17:
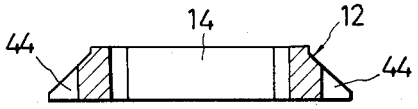
FIG. 17 is a cross-sectional view taken along line XVII—XVII in FIG. 16.
Figure 18:
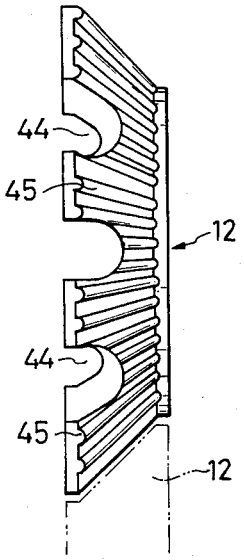
FIGS. 18(*a*) to 18(*c*) are plan views illustrating modifications of the cutter of FIG. 15.
Figure 18:
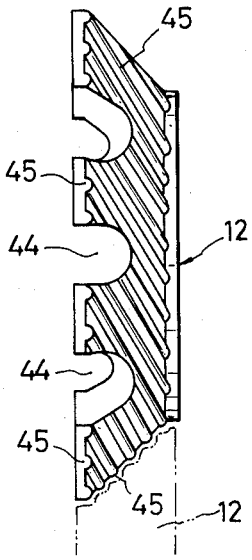
Figure 18:
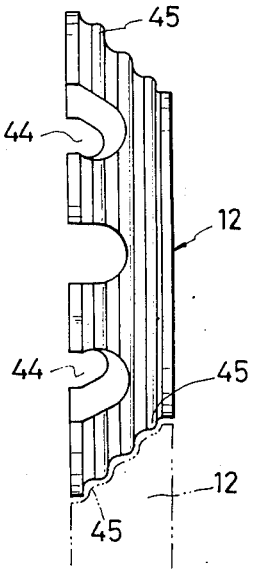

The cutter 12 may optionally be formed in the shape of a truncated cone to have its conical surface provided in the base portion thereof with a multiplicity of catch grooves 44 as illustrated in FIGS. 15 to 17. Specifically, a plurality of such cutters 12 are fitted around cutter shafts 9 and 10 respectively so that the cutters 12 around one of the cutter shafts are arranged in the direction opposite to the direction in which the cutters 12 around the other cutter shaft are arranged and that the cutters 12 around the two cutter shafts 9 and 10 are alternately disposed and brought into intimate contact with one another at their conical surfaces without use of any spacer 13, whereby chips are caught in catch grooves 44 with high exactitude, broken between the conical surfaces of the adjacently intimate cutters 12 and crushed under pressure therebetween. Thus, the cutting apparatus utilizing these cutters has promoted its ability to cut and crush the chips. This ability can further be improved by providing each of the conical surfaces of the cutters 12 with a plurality of projections 45 and arranging the projections in mesh with one another, i.e. placing one projection 45 on one of the opposed conical surfaces between the projections 45 on the other conical surface, as illustrated in FIGS. 18(*a*) to 18(*c*).

Figure 20:
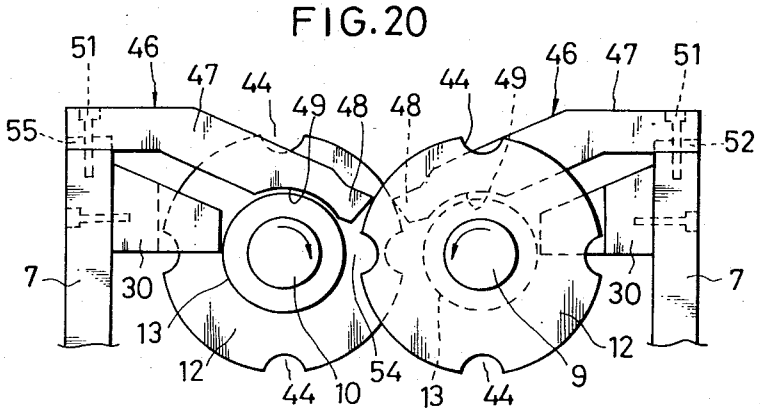
FIG. 20 is a front view illustrating the principal part of the third embodiment.
Figure 19:
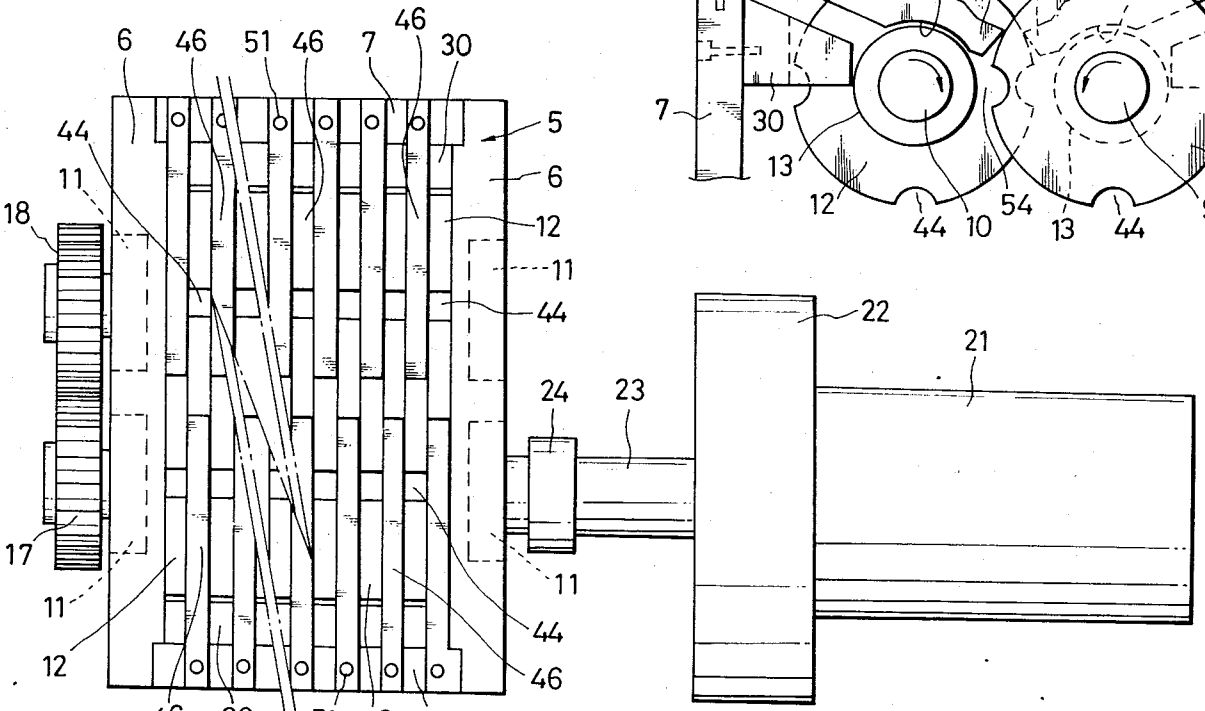
FIG. 19 is a plan view illustrating a third embodiment of the cutting apparatus according to the present invention.
Figure 21:
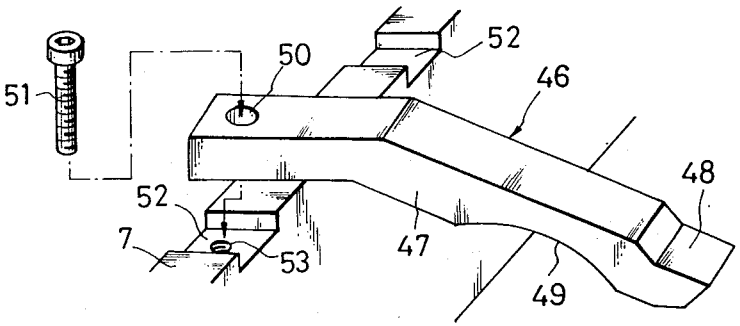
FIG. 21 is a perspective view illustrating the principal part of the third embodiment.

The third embodiment of the cutting apparatus according to the present invention is illustrated in FIGS. 19 through 21. In this embodiment, cutters 12 constituting a cutting implement 5 are formed in the shape of a substantial disk and each of these is provided in its plate surface with a plurality of semi-circular catch grooves 44. Between the axially adjacent cutters, there is interposed a spacer 13 having substantially the same thickness as that of the cutters 12 and a smaller diameter than that of the cutters. On each of the spacers 13, there is disposed a primary cutter 46 of a shape substantially the same as that of an ordinary cutting tool.

The primary cutter 46 comprises a substantially L-shaped rectangular shank portion 47 and a sharp cutting edge portion 48 integrally formed with the leading end of the shank portion 47 as shown in FIGS. 20 and 21. The lower surface of the shank portion 47 has a substantially arcuate concave surface 49 formed therein on its leading end side. The concave surface 49 is positioned immediately above the upper circumferential surface of the spacer 13 and the edge portion 48 is arranged in the vicinity of the circumferential surface of the cutter 12 opposed to the spacer 13. The primary cutter 46 is fixed to the upper end of a lateral frame member 7 by driving a bolt 51 into a bolt hole 50 bored in the rear end of the shank portion 47. In FIGS. 20 and 21, reference numeral 52 denotes a groove formed in the upper end of the lateral frame member 7 at a position corresponding to the position of the spacer 13 for admitting the rear end of the shank portion 47, and numeral 53 denotes a screw hole formed in the bottom of the groove 52.

According to the third embodiment described above, part of the chips is cut by the primary cutters 46 prior to the cutting by the cutters 12 to promote a high-precision cutting operation and, at the same time, the chips not cut are prevented from falling from gaps 54 between the opposed cutters 12 and spacers 13. Thus, the chips can be cut into minute pieces with high exactitude and high precision.

Figure 22:
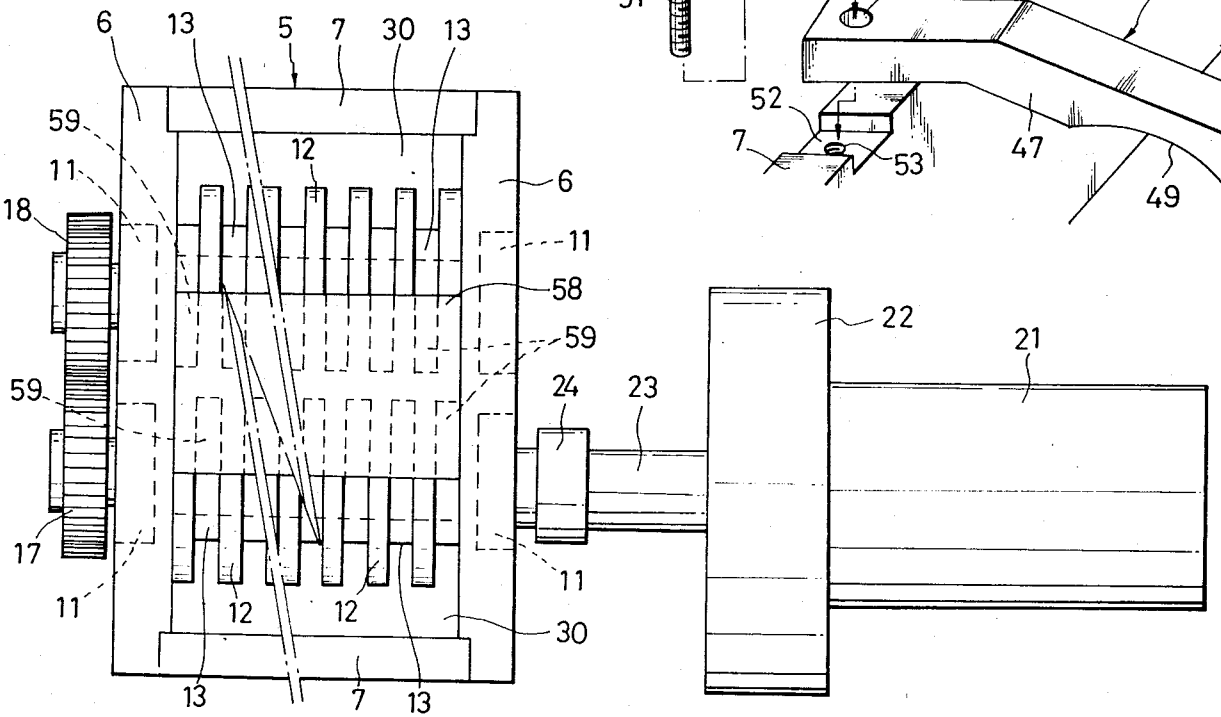
FIG. 22 is a bottom view illustrating a fourth embodiment of the cutting apparatus according to the present invention.
Figure 23:
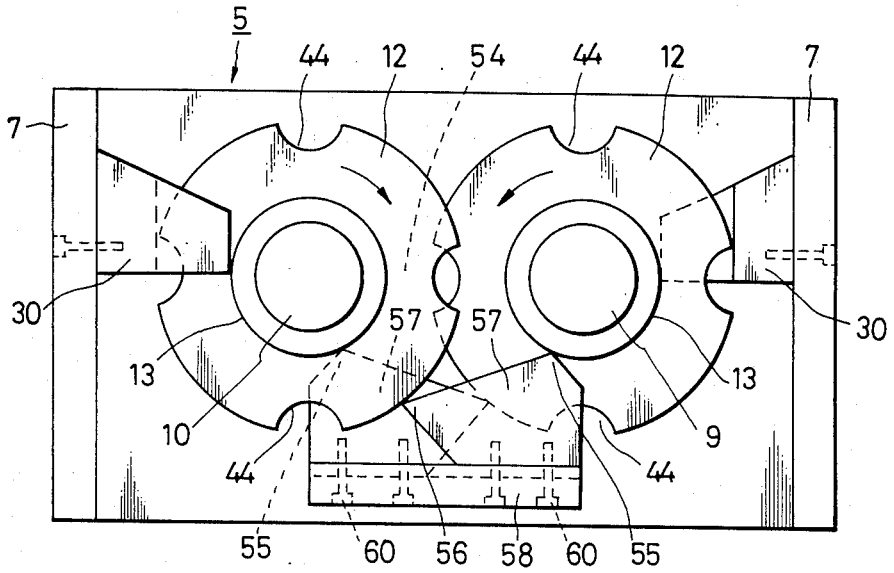
FIG. 23 is a front view illustrating the principal part of the fourth embodiment.
Figure 24:
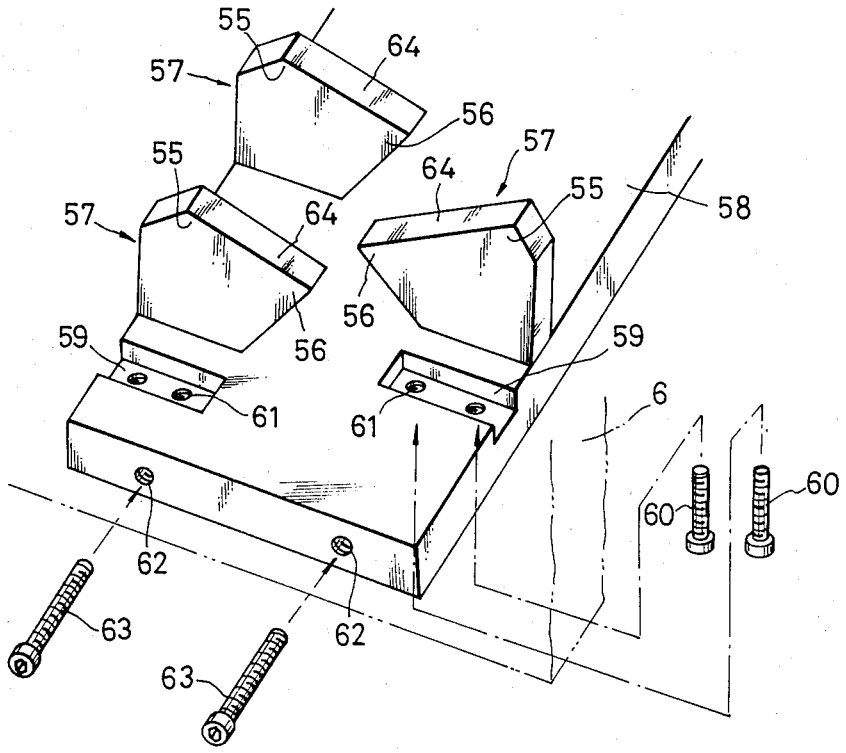
FIG. 24 is a perspective view illustrating the principal part of the fourth embodiment.
Figure 25:
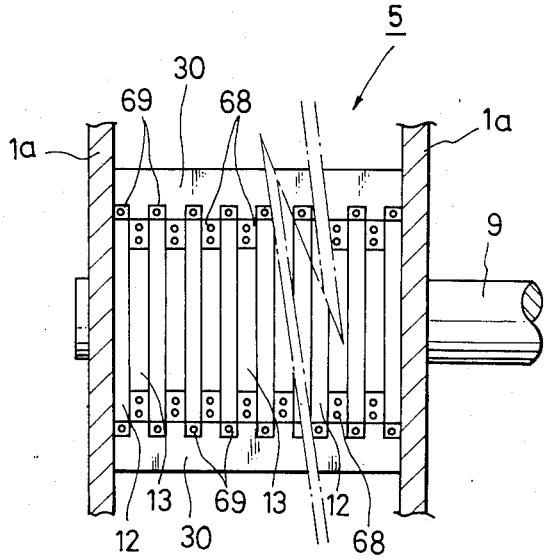
FIG. 25 is a plan view illustrating the principal part of a fifth embodiment of the cutting apparatus according to the present invention.

The fourth embodiment of the cutting apparatus according to the present invention will be described with reference to FIGS. 22 to 24. In this embodiment, a plurality of secondary plate like cutters 57 having substantially the same thickness as that of the cutters 12 are zigzag arranged below the gaps 54 between the opposed cutters 12 and spacers 13. Each of the secondary cutters 57 has its upper cutting edge 55 disposed adjacent to the lower circumferential surface of the spacer 13 and its lower cutting edge 56 disposed adjacent to the lower circumferential surface of the cutter 12 opposed to the spacer 13 and is attached to a groove 59 in a stationary plate 58 by means of bolts 60 at the position of the corresponding cutter 12 and spacer 13 opposed to each other. Optionally, these secondary cutters 57 and the stationary plate 58 may be integrally molded by a molding method. In FIG. 24, reference numeral 61 designates a screw hole formed in the bottom of the groove 59, and numeral 62 depicts another screw hole bored in the end face of the stationary plate 58 so as to register with a screw hole (not shown) in the longitudinal frame member 6. A bolt 63 is driven into each of these screw holes for fixing the stationary plate 58 to the longitudinal frame member 6.

According to the fourth embodiment, the chips falling from the gaps 54 between the opposed cutters 12 and spacers 13 are received on inclined guide surfaces 64 between the upper edges 55 and the lower edges 56 of the secondary cutters 57 and allowed to slide thereon toward the lower edges 56, thereby cutting the chips with the cutters 12 in cooperation with the lower edges 56. Therefore, chip packing due to the narrowness of the gap 54, galling between the chips and the cutters 12 and loss of the drive force of the cutters 12 due to the galling can be eliminated, thereby making it permissible to widen the gaps 54 to some extent and making it possible to cut the chips smoothly.

FIGS. 25 to 28 illustrate the fifth embodiment of the cutting apparatus according to the present invention, in which a single cutter shaft 9 is adopted. The cutter shaft 9 is disposed between the side plates 1*a*, coupled directly to a motor 21 and, provided thereabout with a plurality of cutters 12 and spacers 13 which are arranged alternately. Corrugated scrapers 30 are disposed on the opposite sides of a series of the alternately arranged cutters 12 and spacers 13. Engaging projections 64 and grooves 65 which constitute engaging pawls 31 of the scrapers 30 have notches 66 and 67 formed respectively therein. Chip cutters 68 and 69 are fixed within the notches 66 and 67 by means of bolts 70 and 71, respectively.

Figure 26:
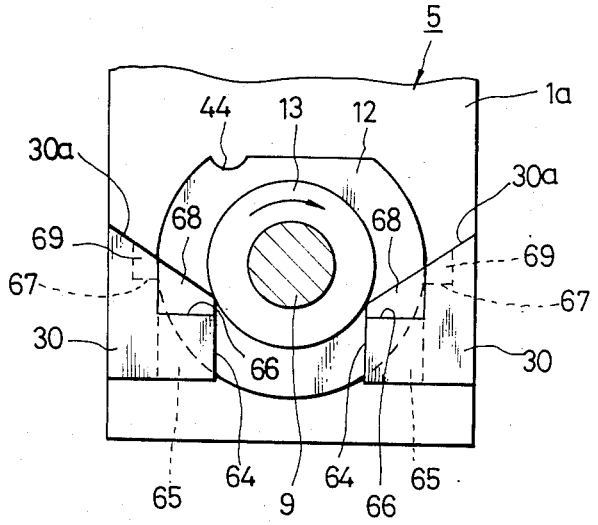
FIG. 26 is a partially sectioned front view illustrating the principal part of the fifth embodiment.
Figure 27:
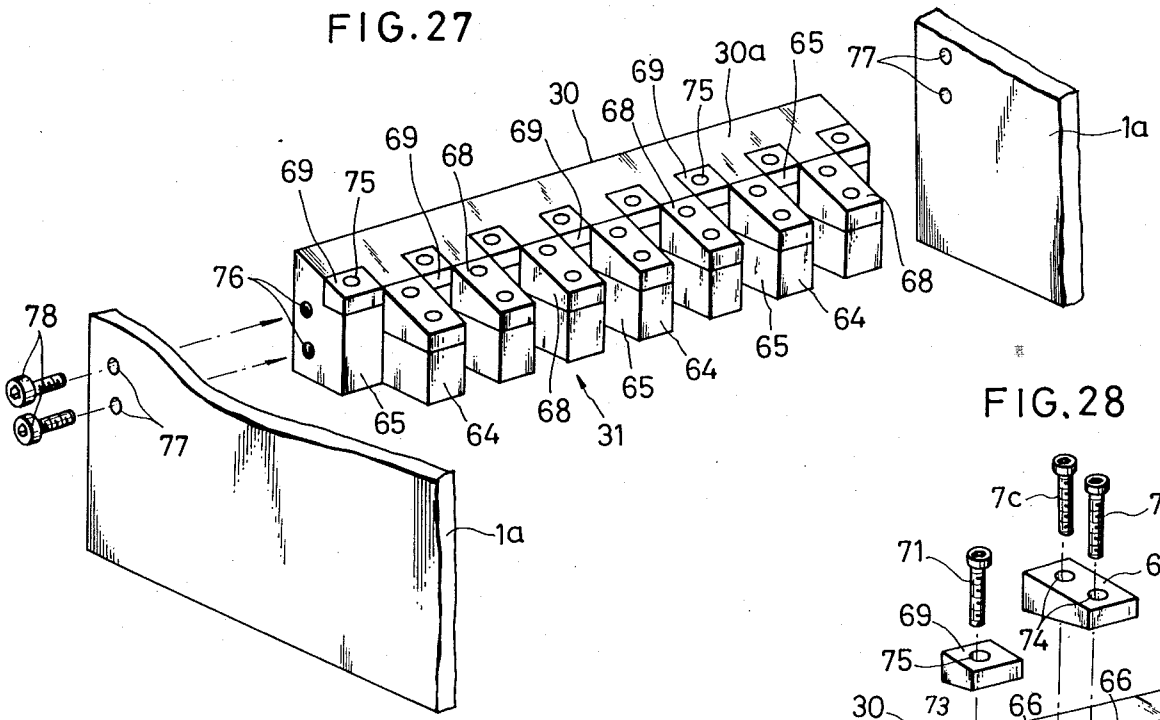
FIGS. 27 and 28 are perspective views illustrating the principal part of the fifth embodiment.
Figure 28:
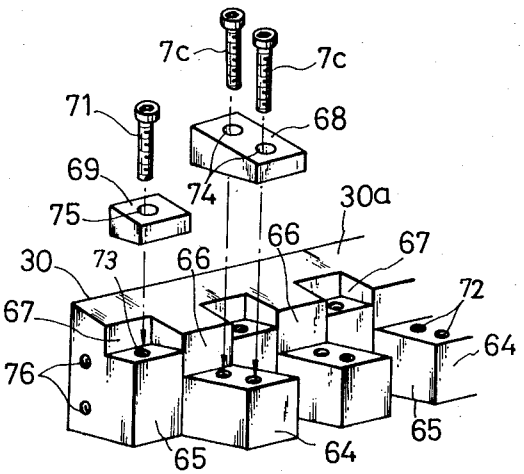

The chip cutters 68 and 69 are substantially wedge-shaped. The chip cutter 69 is smaller in size than the chip cutter 68 and, as illustrated in FIG. 26, the chip cutter 69 has its sharp edge positioned at a level substantially the same as the central axis of the cutter 12 and the chip cutter 68 has its sharp edge located at a level lower than the central axis of the spacer 13. In FIG. 28, reference numerals 72 and 73 denote screw holes formed respectively in the notches 66 and 67, numerals 74 and 75 denote fitting holes bored respectively in the chip cutters 68 and 69, numeral 76 denotes screw holes formed in the side edge surface of the scraper 30, and numeral 77 represents through holes bored in the side plates 1*a* for snugly admitting bolts 78.

According to the fifth embodiment of the present invention, chips supplied between the cutters 12 and chip cutters 69 and between the spacers 13 and chip cutters 68 can be cut into minute pieces by the chip cutters 68 and 69, thereby preventing the chips from slipping off and the so-called galling caused by the slipped chips from occurring and also preventing the motor associated with the cutter shaft 9 from being driven under overload.

Figure 29:
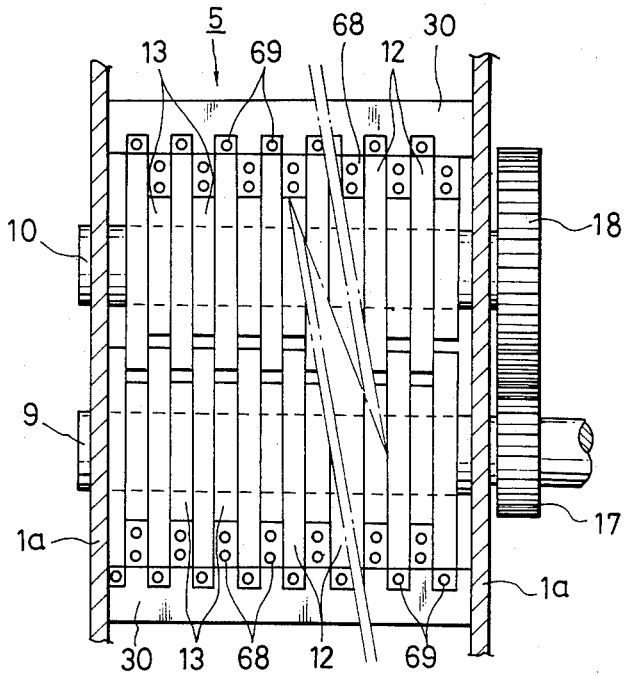
FIG. 29 in a Film then illustrating a modification of the fifth embodiment.
Figure 30:
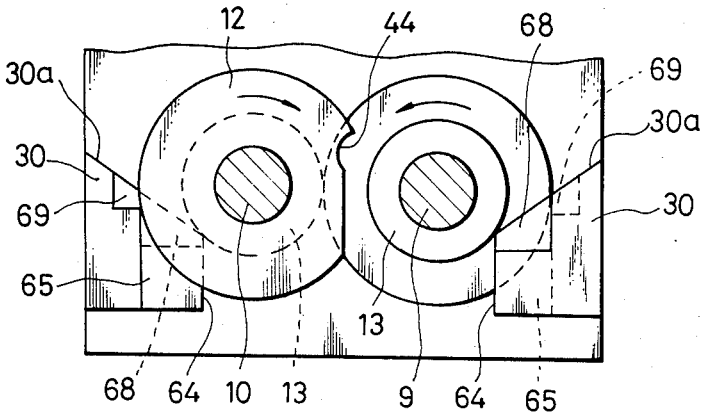
FIG. 30 is a longitudinally sectioned view of FIG. 29.

Means for preventing such an overload operation of the motor 21 may be constructed as illustrated in FIGS. 29 and 30. To be specific, while cutter shafts 9 and 10 have a plurality of cutters 12 and spacers 13 fitted alternately thereabouts in the axial direction so that the cutters around each of the cutter shafts are held in mesh with the opposed spacers 13, the cutter shaft 9 associated with the motor 21 has a small-diameter gear 17 fixed thereto and the other cutter shaft 10 has a large-diameter gear 18 fixed thereto so as to be engaged with the small-diameter gear 17. With this construction, the torque of the small-diameter gear 17 given when the chips are cut and crushed can be reduced, thereby reducing the load exerted on the motor 21 through the cutter shaft 9.

The cutting apparatus of the present invention has been described as applied to the case where chips are cut and crushed. However, the present invention should not be limited to this case. It goes without saying that the present invention may be applied to a cutting apparatus or crusher for glass, wood, plastic, scraps discharged out of a press, for example.

What is claimed is:

1. A cutting apparatus, comprising:

a conveyor having a takeout end;

a pair of upper side plates disposed immediately below said takeout end; first and second cutter shafts disposed substantially in parallel to each other with a prescribed spacing, and interposed between said pair of upper side plates;

a pair of lower side plates, each having first semi-circular bearing notches bored therein, each of said pair of upper side plates having second semi-circular bearing notches bored therein and having detachably connected thereto respective ones of said lower side plates such that said first semi-circular bearing notches, in cooperation with said second semi-circular bearing notches, form circular openings admitting said first and second cutter shafts;

a motor attached to said first cutter shaft for rotating said first cutter shaft;

means for rotating said second cutter shaft in a direction opposed to the direction in which said first cutter shaft is rotated;

a plurality of first substantially disklike cutters fitted around said first cutter shaft;

a plurality of first substantially disklike spacers fitted around said first cutter shaft; said first cutters and said first spacers fitted around said first cutter shaft being alternately arranged and brought into intimate contact with each other in the axial direction of said first cutter shaft;

a plurality of second substantially disklike cutters fitted around said second cutter shaft; and a plurality of second substantially disklike spacers fitted around said second cutter shaft, said second cutters and said second spacers fitted around said second cutter shaft being alternately arranged and brought into intimate contact with each other in the axial direction of said second cutter shaft, each of said first cutters and each of said second spacers being closely opposed to each other and each of said second cutters and each of said first spacers being closely opposed to each other so as to hold said first and second cutters in mesh with each other.

2. The cutting apparatus according to claim 1, wherein said first and second cutter shafts, said pair of upper side plates, said lower side plates, said first and second cutters and said first and second spacers constitute a cutting implement having a frame, said pair of upper side plates and said lower side plates forming said frame.

3. The cutting apparatus according to claim 1, wherein said first and second cutter shafts, said pair of upper side plates, said lower side plates, said first and second cutters and said first and second spacers constitute a cutting implement, said apparatus further comprising connection levers connecting said pair of upper side plates to each other to mount said cutting implement at a position immediately below said takeout end of said conveyor.

4. A cutting apparatus, comprising:

a cutting implement including first and second cutter shafts disposed substantially in parallel to each other, a plurality of first substantially dislike cutters fitted around said first cutter shaft, a plurality of first substantially dislike spacers fitted around said first cutter shaft, said first cutters and said first spacers fitted around said first cutter shaft being alternately arranged and brought into intimate contact with each other in the axial direction of said first cutter shaft, a plurality of second substantially dislike cutters fitted around said second cutter shaft, a plurality of second substantially dislike spacers fitted around said second cutter shaft, said second cutters and said second spacers fitted around said second cutter shaft being alternately arranged and brought into intimate contact with each other in the axial direction of said second cutter shaft, each of said first cutters and each of said second spacers being closely opposed to each other and each of said second cutters and each of said first spacers being closely opposed to each other so as to hold said first and second cutters in mesh with each other;

a motor attached to said first cutter shaft for rotating said first cutter shaft;

means for rotating said second cutter shaft in a direction opposite to the direction in which said first cutter shaft is rotated;

a conveyor having a takeout end and a conveyor casing having opposing side plates at said takeout end; and support arms having respective first ends thereof fixed to said cutting implement in opposing relation, and respective second ends thereof fixed to said side plates so as to mount said cutting implement at a position immediately below said takeout end of the conveyor so as to depend therefrom.

5. The cutting apparatus according to claim 4, wherein each of said side plates having a substantially elliptical said first and second cutters have a same length diameter through hole formed in a lower portion thereof so as to have a minor diameter larger than said same length diameter said apparatus further comprising a pair of cover plates removably mounted to said side plates so as to cover said through hole, said cover plates having holes therein rotatably receiving said first and second cutter shafts, whereby said cutting implement can be removed from said apparatus through said through hole in the axial direction of said first and second cutter shafts together with said cover plates by detaching said cover plates from said side plates.

6. A cutting apparatus, comprising:

a cutting implement including a frame, first and second cutter shafts disposed substantially in parallel to each other, a plurality of first substantially dislike cutters fitted around said first cutter shaft, a plurality of first substantially dislike spacers fitted around said first cutter shaft, said first cutters and said first spacers fitted around said first cutter shaft being alternately arranged and brought into intimate contact with each other in the axial direction of said first cutter shaft, a plurality of second substantially dislike cutters fitted around said second cutter shaft, a plurality of second substantially dislike spacers fitted around said second cutter shaft, said second cutters and said second spacers fitted around said second cutter shaft being alternately arranged and brought into intimate contact with each other in the axial direction of said second cutter shaft, each of said first cutters and each of said second spacers being closely opposed to each other and each of said second cutters and each of said first spacers being closely opposed to each other, so as to hold said first and second cutters in mesh with each other;

a motor attached to said first cutter shaft for rotating said first cutter shaft, means for rotating said second cutter shaft in a direction opposite to the direction in which said first cutter shaft is rotated;

a stationary plate mounted on a lower portion of said frame of said cutting implement; and a plurality of secondary platelike cutters formed in two rows on said stationary plate in the axial direction of said first and second cutter shafts and disposed immediately below said first and second spacers, each of said secondary platelike cutters in one of said two rows having an upper cutting edge disposed adjacent to a lower circumferential surface of said first spacer and having a lower cutting edge disposed adjacent to a lower circumferential surface of said second cutter, each of said secondary platelike cutters in the other of said two rows having an upper cutting edge disposed adjacent to said lower circumferential surface of said second spacer and having a lower cutting edge disposed adjacent to said lower circumferential surface of said first cutter.

* * * * *